United States Patent [19]

Horibe et al.

[11] Patent Number: 4,944,084

[45] Date of Patent: Jul. 31, 1990

[54] FUSE AND MANUFACTURING METHOD THEREOF

[75] Inventors: Kinya Horibe; Hirohiko Fujimaki, both of Shizuoka, Japan

[73] Assignee: Yazaki Corporation, Japan

[21] Appl. No.: 327,088

[22] Filed: Mar. 22, 1989

[30] Foreign Application Priority Data

Mar. 23, 1988 [JP] Japan ..... 63-67354
Mar. 23, 1988 [JP] Japan ..... 63-67356

[51] Int. Cl.[5] ..... H01H 69/02; H01H 85/04

[52] U.S. Cl. ..... 29/623; 337/160; 337/296

[58] Field of Search ..... 337/296, 160, 290, 295; 29/623

[56] References Cited

FOREIGN PATENT DOCUMENTS

0016467A1 3/1980 European Pat. Off. .
484782 5/1938 United Kingdom ..... 337/296
538232 7/1941 United Kingdom ..... 337/296
742968 1/1956 United Kingdom .
1118298 6/1968 United Kingdom .
1369227 10/1974 United Kingdom .
1089148A 11/1981 United Kingdom .
2120027A 5/1983 United Kingdom .
2148626A 5/1985 United Kingdom .

*Primary Examiner*—H. Broome
*Attorney, Agent, or Firm*—Wigman & Cohen

[57] ABSTRACT

A fuse comprising a fuse element made by fixing a low-melting-point metal chip to a high-melting-point metal conductor, in which oxidatoin of the portions of the metal chip that are in contact with the metal conductor is prevented by [either partially fusing or soldered the metal chip to the metal conductor, or by] forming a layer of oxidation resistant material over the metal chip and then partially fusing the metal chip to the metal conductor.

4 Claims, 3 Drawing Sheets

FUSE AND MANUFACTURING METHOD THEREOF

BACKGROUND OF THE INVENTION

1. Field of the Invention

The present invention relates to a fuse, and in particular to a cartridge-type fuse and a manufacturing method therefor.

2. Description of the Prior Art

In the field of cartridge fuses there is one particularly interesting prior art fuse disclosed in Japanese Laid-Open Utility Model Publication No. 59-66844, in which a high-melting-point, fusible metal conductor, such as a copper or tinned copper conductor, is provided with a low-melting-point metal chip, such as a tin chip. In this fuse, the low-melting-point chip is selected so as to melt and fuse to the high-melting-point conductor to form an alloy therewith when the electric current passing through the metal conductor exceeds the predetermined rating of the fuse. The end result is that the alloy, having a relatively high electrical resistance, will either rupture or melt due to the excessive electric current.

With reference to FIGS. 1 and 2, there is shown a specific example of the type of fuse mentioned above. Namely, as shown in FIG. 1, a fuse element 1 comprises a metal conductor 2 having a recess 2*a* and a clamping strip 2*b* at a central portion thereof for holding a tin chip 3. The metal conductor 2 is further provided with welding portions 2*c* and stoppers 2*d* formed at both ends thereof.

Next, with reference to FIG. 2, a fuse 5 is shown comprising the fuse element 1 and terminal fittings 4 which are to be welded to the fuse element 1. As illustrated, the fuse element 1 is shown in a state in which the clamping strip 2*b* is bent around the tin chip 3, and the terminal fittings are shown comprising base portions 4*a*, notches 4*c* for receiving the stoppers 2*d* of the metal conductor 2, and welding surfaces 4*b* for receiving the welding portions 2*c* to be welded therewith. Finally, even though it is not shown in FIGS. 1 and 2, the fuse 5 is partially encased in protective insulation.

Besides the example just given, it is also possible to construct the same type of cartridge fuse by forming the metal conductor and terminal fittings together as a single element, and thus avoid the step of welding. Moreover, it is also possible to replace the recess in the metal conductor with a plurality of lateral grooves in order to improve the contact between the tin chip and the metal conductor, as suggested by Japanese Laid-Open Utility Model Publication No. 62-1349.

Unfortunately, however, all these prior art cartridge fuses have the disadvantage that their response times, i.e., the time it takes for the fuse element to either melt or rupture, due to excessive electrical current flow, increase long periods of use. As for why these decays in response time occur, extensive research has revealed that the tin chip becomes oxidized over long periods of use, especially when used in environments that are fairly high in temperature. This oxidation then leads to a direct slowing down in the chip's ability to melt and fuse with the high-melting-point metal conductor.

SUMMARY OF THE INVENTION

In view of the disadvantages of the prior art fuses, it is an object of the present invention to provide a fuse having constant response characteristics, even when used over long periods of time in heated environments.

It is another object of the present invention to provide a fuse having a fuse element comprising a high-melting point metal conductor and a low-melting point metal chip, in which the portions of the metal chip that are in contact with the metal conductor are protected from oxidation.

For accomplishing the above objectives, the fuse according to the present invention comprises a fuse element having a high-melting-point metal conductor and a low-melting-point metal chip held by the metal conductor, in which one or more of the following oxidation prevention means are employed: (1) the portions of the metal chip that are in contact with the metal conductor are partially fused to the contacting portions of the metal conductor; (2) the portions of the metal chip that are in contact with the metal conductor are coated with a layer of material that is resistant to oxidation; or (3) the metal chip is soldered to the metal conductor so as to seal off those portions of the metal chip that are in contact with the metal conductor. For means (1) mentioned above, a low-melting-point metal powder may optionally be provided to help facilitate fusing.

In addition, the present invention also embodies associated methods of manufacturing the fuse in order to achieve the three oxidation prevention means mentioned above.

The foregoing, and other objects, features, and advantages of the present invention will become more apparent from the detailed description of the preferred embodiments taken in conjunction with the accompanying drawings.

DETAILED DESCRIPTION OF THE PREFERRED EMBODIMENTS

Figure 3:
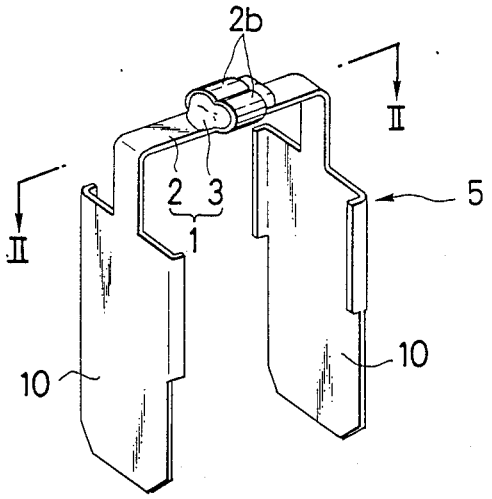
FIG. 3 is a perspective view of a one embodiment of a fuse according to the present invention.
Figure 4:
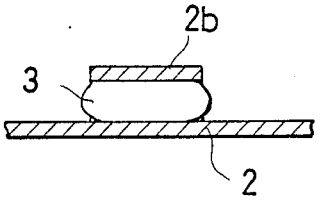
FIGS. 4 and 5 are a cross-sectional views of an essential portion of the fuse element of the fuse shown in FIG. 3 taken along lines II—II, showing, respectively, the state of a tin chip before and after pre-fusing has taken place.
Figure 5:
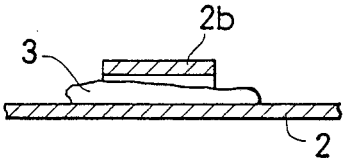

With reference to FIGS. 3–5, a fuse according to a first embodiment of the present invention will be described.

Namely, as shown in FIG. 3, a fuse 5 comprises a fuse element 1 and terminal fittings 10. The fuse element 1 in turn comprises a high-melting-point metal conductor 2 which is integrally formed with the terminal fittings 10, a low-melting-point metal chip 3 provided on one surface of the metal conductor 2, and clamping portions **2*b* for securing the low-melting-point metal chip 3 to the metal conductor 2. The fuse element 1 is further characterized in that the metal chip 3 is partially fused to the metal conductor 2**.

For the above construction, the metal conductor 2 can be formed from any high-melting-point metal such as copper, tinned copper, copper alloys, aluminum and aluminum alloys, with tinned copper being the preferred choice. For the metal chip 3, several kinds of low-melting-point metal chips may be employed, but the use of a tin chip is preferred.

In manufacturing the fuse 1 described above, the metal conductor 2, the clamping portions **2*b* and the terminal fittings 10 are all integrally formed as a single unit. Then, as shown in FIG. 4, the metal chip 3 is placed on the metal conductor 2 and secured thereon by the clamping portion 2*bs*. Lastly, an electric current exceeding the preset allowable current for the fuse 5 is passed through the fuse element 1 for a short time sufficient enough to only partially fuse the metal chip 3 with the contacting surfaces of the metal conductor 2 and the clamping portions 2*b*, resulting in the structure shown in FIG. 5**.

In addition to the method just given, there is an alternative method of manufacturing the fuse 5, in which the final step of passing an electric current through the fuse element 1 mentioned above is replaced by the step of externally heating the fuse element. As the resulting structure obtained by this alternative method is essentially the same as that obtained by the method described above, there is no preference of one method over the other.

Figure 6:
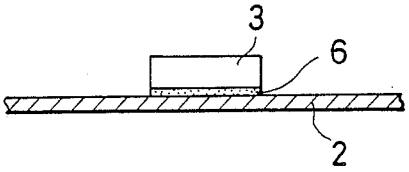
FIG. 6 is a cross-sectional view similar to FIGS. 4 and 5, showing the provision of a low-melting-point metal powder in a second embodiment of a fuse according to the present invention.

Next, as shown in FIG. 6, a second embodiment of a fuse according to the present invention is shown to be the same as the first embodiment, with the exception that the second embodiment is additionally provided with a low-melting-point metal powder 6 having the same composition as the metal chip 3 before the metal chip 3 is secured by the clamping portions **2*b*. This metal powder 6 is provided so that the partial fusion of the metal chip 3 to the metal conductor 2 can be carried out more efficiently. Moreover, since the methods for manufacturing the fuses according to the first and second embodiments are essentially the same, the metal powder 6 additionally serves to speed up the final step of partially fusing the metal chip 3 to the metal conductor 2**.

In the second embodiment described above, it is only necessary to apply the metal powder 6 to those portions of the metal chip 3 that will be in contact with the metal conductor 2, but if desired the metal powder 6 may be applied to the entire surface of the metal chip 3. In this case, it is preferable that the individual particles of the powder have grain diameters between 10 to 80 microns, and that the metal chip 2 be slightly heated in order to ease the application of the metal powder 6 thereto.

Figure 7:
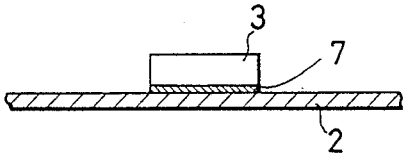
FIG. 7 is a cross-sectional view showing a tin chip having an oxidation resistant coating applied to a portion thereof in a third embodiment of a fuse according to the present invention.

Now, as shown in FIG. 7, a third embodiment of a fuse according to the present invention is slightly different from the first and second embodiments. Namely, for the third embodiment there is no partial fusing of the metal chip 3 to the metal conductor 2, as was the case for the first two embodiments. Instead, oxidation prevention is effected by forming on the metal chip 3 a thin layer of oxidation resistant material 7.

For this third embodiment, the oxidation-resistant layer 7 is formed on the metal chip 3 before the metal chip 3 is secured to the metal conductor 2. In this respect, it is sufficient to form the oxidation resistant layer 7 only on those portions that will be in contact with the metal conductor 2, but, if desired, the oxidation resistant layer 7 may be applied over the entire surface of the metal chip 3.

On the other hand, it is important that the material being used for the oxidation resistant layer 7 be selected so as to not impair the ability of the metal chip 3 to melt and fuse with the metal conductor 2 when the current passing through the metal conductor 2 surpasses the predetermined rating of the fuse. For this purpose, any of the following elements from Group VIII or Group IB of the periodic table will suffice: cobalt (Co), nickle (Ni), palladium (Pd) and platinum (Pt) (Group VIII); or copper (Cu), silver (Ag) and gold (Au) (Group IB). Of these, copper has the highest relative rate of oxidation. However, since its heat conducting ability is not adversely affected in any significant way by such oxidation, and in view of its relatively low cost, copper is the preferred choice.

In manufacturing a fuse according to the third embodiment described above, the step of forming the oxidation-resistant layer 7 on the metal chip 3 is carried out by any suitable plating or vapor deposition means. Then, once the forming of the oxidation-resistant layer 7 has been completed, the metal chip 3 is secured to the metal conductor 2 in the same manner as that employed in the first two embodiments, with the elimination of the step of partially fusing the metal chip 3 to the metal conductor 2.

Figure 8:
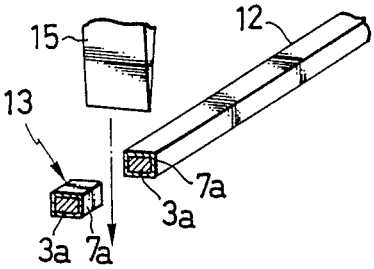
FIG. 8 is perspective view showing one method of making oxidation resistant coated tin chips for the third embodiment of a fuse according to the present invention.

To help illustrate the method mentioned above, FIG. 8 shows a specific example of how to make a metal oxidation-resistant coated metal chip. In this example, an oxidation-resistant coated bar 12, made by forming a layer of oxidation-resistant material **7*a* on a tin bar 3*a*, is chopped by a cutting blade 15 to form individual oxidation-resistant metal chips 13**.

Lastly, with reference to FIG. 9, a description of a fuse according to a fourth embodiment of the present invention will be given. However, since the general overall structure of the fourth embodiment is very similar to that of the first embodiment, only those parts of the fourth embodiment that are significantly different from the first embodiment will be explained.

Figure 9:
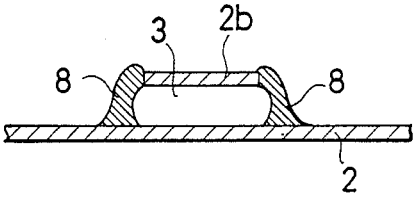
FIG. 9 is cross-sectional view similar to FIGS. 4–6, showing the tin chip being sealed by solder in a fourth embodiment of a fuse according to the present invention.

As shown in FIG. 9, the main difference between the fuses of the first and fourth embodiments is that for the fuse of fourth embodiment the metal chip 3 is not partially fused to the metal conductor 2. Instead, the metal chip 3 is soldered to the metal conductor 2 by solder 8 applied in such a way as to completely seal off from any external exposure at least those portions of the metal chip 3 that are in contact with the metal conductor 2. For this purpose, the use a solder having a melting point below that of the metal chip 3, such as an alloy of tin and lead, is preferred. Also, if so desired, the solder 8 may be applied to completely seal off all portions of the metal chip 3, but it is sufficient merely to seal off those portions of the metal chip 3 that are in contact with the metal conductor 2.

In manufacturing the fuse according to the fourth embodiment, the same steps that were used for making the fuse according to the first embodiment may be employed, with the final step of partially fusing the metal chip 3 to the metal conductor 2 simply being replaced by the step of soldering the metal chip 3 to the metal conductor 2. For carrying out this final step of soldering, any conventional means is appropriate.

Figure 1:
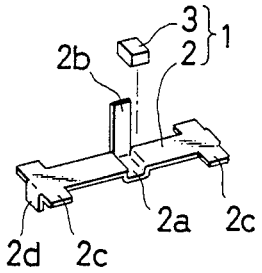
FIG. 1 PRIOR ART
FIG. 1 is a perspective view of a prior art fuse element used for cartridge fuses.
Figure 2:
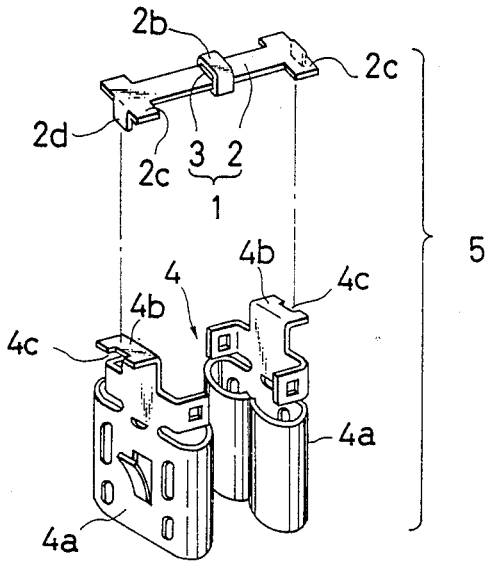
FIG. 2 PRIOR ART
FIG. 2 is a perspective view of a prior art cartridge fuse showing the fuse element of FIG. 1 in relation to the terminal fittings of the fuse.

For all four embodiments described hereinabove, the fuse element and the terminal fittings were described as being integrally formed as a single unit. However, it should be understood that it is also possible for all of these embodiments to have separately formed fuse elements and terminal fittings which can then be joined together, such as is shown for the prior art fuse in FIGS. 1 and 2. In addition, for supporting the metal chip, the metal conductors of the fuse according to the present invention may be formed so as to have a plane, a recess, lateral grooves or the like.

Now, in concert with the objects of the present invention, by either partially fusing or sealing off the portions of the metal chip that are in contact with the metal conductor, or by providing an oxidation resistant layer to the metal chip, the contacting portions are protected from oxidation. Thus, when an electrical current flowing through the fuse exceeds the predetermined rating thereof, the chip will melt and fuse with the metal conductor to form an alloy that will either melt or rupture, and this will occur without any significant change in response time even when the fuse has been used for long periods of time in heated environments.

For confirming the effect of the present invention, several fuses made in accordance with the embodiments described above were tested against conventional fuses. The results indicated that the fuses made in accordance with the present invention had durabilities as high as five times the durabilities of the convential fuses. In particular, the fuse made in accordance with the second embodiment of the present invention proved to have the highest durability.

Finally, it is to be understood that even though the present invention has been described in its preferred embodiments, many modifications and improvements may be made without departing from the scope of the invention as defined by the appended claims.

What is claimed is:

1. A method of manufacturing a fuse having a predetermined electrical current rating, in which the fuse comprises a metallic fuse element made from a material having a relatively high melting point and a metallic chip made from a material having a relatively low melting point and having at least one contacting surface to the fuse element, the chip being adapted to melt and fuse with the fuse element to form an alloy therewith when an overcurrent which generates a heat melting only the material of the metallic chip flows through the fuse, and the formed alloy having a relatively high electrical resistance such that the alloy will be melted and the fuse will be rapidly ruptured by an overcurrent which exceeds the predetermined electrical current rating flowing through the fuse, and the fuse having means for preventing oxidation of the contacting surface of the metallic chip to the fuse element, the method comprising the steps of:

applying a metallic powder to the at least one contacting surface of the metallic chip;

placing the metallic chip onto the fuse element in such a manner that the contacting surface having the metallic powder contacts the fuse element; and passing an electrical current to the fuse element for melting the metallic powder so as to partially fuse the chip to the fuse element, whereby said oxidation preventing means is formed.

2. The method of claim 1, wherein the metallic powder has a characteristic melting point substantially the same as the melting point of the chip.

3. The method of claim 2, wherein the metallic powder comprises a tin powder having an average particle size of about 10 to 80 $\mu$.

4. The method of claim 3, wherein the electrical current for melting the metallic powder is limited to the amount which generates a heat in the fuse element slightly exceeding a temperature of the melting point of tin, and the electrical current is passed for a short period sufficient to only partially fuse the chip to the fuse element.

* * * * *